United States Patent [19]

Schuttenberg et al.

[11] 4,266,572

[45] May 12, 1981

[54] ELECTROHYDRAULIC DIRECTIONAL CONTROL VALVE SYSTEM

[75] Inventors: Eckard Schuttenberg, Stuttgart; Manfred Hauser; Winfried Hommen, both of Schwieberdingen; Klaus Sopha, Stuttgart, all of Fed. Rep. of Germany

[73] Assignee: Robert Bosch GmbH, Stuttgart, Fed. Rep. of Germany

[21] Appl. No.: 73,544

[22] Filed: Sep. 7, 1979

[30] Foreign Application Priority Data

Sep. 20, 1978 [DE] Fed. Rep. of Germany ..... 2840831

[51] Int. Cl.[3] ..... F15B 13/043

[52] U.S. Cl. ..... 137/625.63; 137/625.64

[58] Field of Search ..... 137/625.63, 625.64

[56] References Cited

U.S. PATENT DOCUMENTS 2,953,123 9/1960 Reen et al. ..... 137/625.64 X 3,450,160 6/1969 Tess ..... 137/625.64

3,995,532 12/1976 Junck et al. ..... 137/596.13 X

*Primary Examiner*—Gerald A. Michalsky

*Attorney, Agent, or Firm*—Michael J. Striker

[57] ABSTRACT

The electrohydraulic directional control valve system includes a preliminary directional control valve and a main control valve, the latter having a control spool which is normally brought into its neutral or blocking position by means of two springs arranged in pressure chambers at respective ends of the control spool. The preliminary control valve has a sliding spool which at one end is urged by a spring into an additional safety position in which the pressure chambers of the main control valve are interconnected and pressure relieved, and the intake of the pressure fluid is blocked. A single proportionally operating solenoid counteracts the spring at the other end of the control spool of the preliminary control valve.

5 Claims, 2 Drawing Figures

A B
T P
P T

ELECTROHYDRAULIC DIRECTIONAL CONTROL VALVE SYSTEM

BACKGROUND OF THE INVENTION

This invention relates generally to electrohydraulic directional multi-way control valve systems, and more particularly it relates to a system of the type which includes a preliminary directional control valve and a main directional control valve, the main control valve having a first housing defining an intake port, a return port, and at least two load ports, a first control spool movable in the housing from a central neutral position into one of two lateral working positions, a pressure chamber arranged at each end of the first spool, first spring arranged in each pressure chamber to urge the first spool into its neutral position, control channels connecting, respectively, the pressure chambers to the preliminary control valve, the preliminary control valve having a second housing provided with two control chambers, a second control spool movable in the second housing from a neutral central position into one of two lateral working positions in which pressure fluid is admitted through one of said control chambers into one of said pressure chambers, whereas the other pressure chamber is released through the return port.

A directional control valve system of this kind is known, for example from the publication "*Zeitschrift Olhydraulik und Pneumatik,*" volume 22, 1978, No. 3, page 116. In this known system, the control spool of the preliminary control valve is acted upon by two proportional solenoids arranged at the opposite end faces of the spool and the latter is centered by two springs. If this preliminary directional control valve is employed for the preliminary control of a 4/3-way control valve acting as the main control stage, so in the case of an interruption of the flow of the pressure fluid or in the case of a failure of the controlling electronic the control slider of the main control stage becomes centered in its neutral central position in which a working cylinder connected to the main control stage becomes hydraulically blocked and consequently a malfunction of a controlled machine is prevented. The disadvantage of this prior-art solution resides in the fact that the operational security can be attained only by employing two proportional operating solenoids cooperating with adjustable springs so that the construction expenses are relatively high.

SUMMARY OF THE INVENTION

It is, therefore, a general object of the present invention to overcome the aforementioned disadvantage.

More particularly, it is an object of the invention to provide an improved directional control valve system of the above-described type in which an equal measure of the operational security can be achieved with essentially reduced construction cost by employing a single proportionally operating solenoid instead of two solenoids which hitherto have been necessary.

Another object of this invention is to employ a single biasing spring in the preliminary control valve which no longer needs to be adjusted.

A further object of the invention is to provide such an improved directional control valve system in which commercially available construction parts can be employed or where existing directional multi-way control valves can be easily modified to suit the structure according to this invention.

In keeping with these objects and others which will become apparent hereafter, one feature of the invention resides in a directional multi-way control valve system of the above-described type in the provision of an additional position of the spool of the preliminary control valve in which the control chambers of the latter are interconnected, a single spring arranged at one end of the control spool of the preliminary control valve to urge the same into the additional position and a single proportionally operating solenoid acting on the other end of the spool to counteract the spring.

This novel arrangement makes it possible that in the case of the interruption of the flow of pressure fluid or in the case of a defective control electronic, the spring urges the spool of the preliminary control stage into the additional safety position in which the two pressure chambers of the main control stage are interconnected via the two control chambers in the preliminary stage. In this manner, the control spool of the main control stage is pressure balanced and is centered into its neutral position by its lateral spring and consequently blocks the load ports whereby the malfunction of the control machine is prevented.

In a preferred embodiment of this invention, the control spool of the preliminary control valve separates in the addition or safety position thereof the intake channel for the pressure fluid from the control chambers in the preliminary control valve. In this manner the directional control system of this invention attains a particularly high degree of security inasmuch as by blocking the intake channel in the additional or safety position a rapid pressure balance between the pressure chambers of the main stage is attained and the main control spool is quickly displaced into its neutral position. Furthermore, in the additional or safety position no pressure fluid flow can be returned to the tank and any unnecessary loss of energy is eliminated.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figures 1, 2:
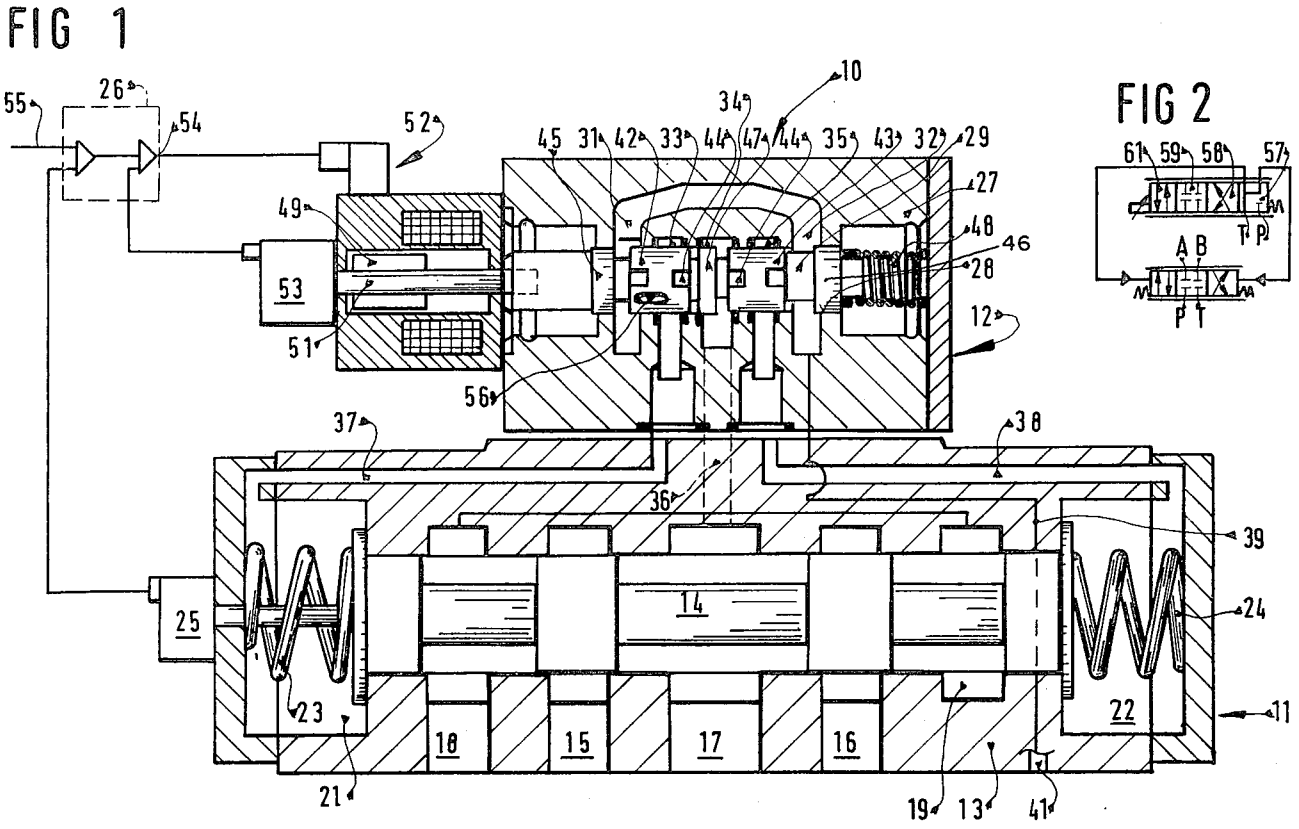
FIG. 1 is a schematic sectional side view of a simplified example of an electrohydraulic directional multi-way control system of this invention.
FIG. 2 is a circuit diagram of the valve system of FIG. 1.

FIG. 1 shows an electrohydraulic directional control valve system 10 including a main directional control stage 11 and a preliminary control stage 12. The main control stage 11 has a housing 13 and a control spool 14 movable in the housing in two opposite directions from the illustrated neutral position thereof in which it hydraulically blocks two load ports 15 and 16 and separates these ports from a pump or intake port 16 and from two ports of external return flow chambers 18 and 19. The end faces of the main control spool 14 communicates respectively with two pressure chambers 21 and 22. Each of the pressure chambers accommodates a spring 23 or 24 which urges the control spool 14 into its neutral position. The actual position of the control spool 14 is measured by an inductively operating position pick-up device 25 and applied to an electronic control device 26.

The preliminary directional control valve 12 has a housing 27 provided with a passage 28 for slidably guiding a spool 29 acting as the control member of the preliminary control stage. Two discharge chambers 31 and 32 communicate with the spool bore 28 and between the two discharge chambers there are arranged in a conventional manner a first control chamber 33, an intake chamber 34 and a second control chamber 35. The intake chamber 34 is connected via an intake channel 36 to the pump or intake port 17. A first control channel 37 leads from the first control chamber 33 to the first pressure chamber 21. In the same manner a second control channel 38 connects the second control chamber 35 to the second pressure chamber 22. The discharge chambers 39 and 32 are connected via a discharge conduit 39 to an additional return flow port 41 for the control oil. The spool 29 of the preliminary control valve has a first spool section 42 and a second spool section 43 each provided at its both end faces with recess and transversely directed control grooves 44. In the axial outward direction from the spool sections 42 and 43 the spool 29 is provided with a third spool section 45 and a fourth spool section 46. At the center of the spool between the first and second spool sections 42 and 43 is provided a fifth spool section 47. A biasing spring 48 acts on the outer face of the fourth spool section 46 whereas on the opposite end face of the preliminary control spool 29 acts via a plunger 51 an armature 49 of a proportionally operating solenoid 52. The actual position of the preliminary control spool 29 is ascertained by an inductively operating second position pick-up device 53 and applied to the electronical controlling device 26. The proportionally operating solenoid 53 is connected to the output 54 of the control device 26; the desired or nominal position value is applied to the input 55 of the device 26. The first spool section 42 of the preliminary control spool 29 is provided on its periphery with an axially directed relief groove 56. The latter is slightly longer than the thickness of the wall of the housing 27 between the first discharge chamber 31 and the first control chamber 33. The ends of this relief groove 56 are spaced apart from the ends of the first spool section 42 and also are spaced from the transverse groove 44 which is arranged in the end face of the section 42 facing the fifth spool section 47.

As clearly illustrated in FIG. 2, the preliminary control spool 29 according to this invention can take four switching positions. In the case of a deenergized proportional solenoid 52, the spring 48 forces the preliminary control spool 29 into the additional fourth position 57 as illustrated in FIG. 2. From this fourth switching position 57 the proportional solenoid 52 can displace the preliminary control spool 29 into the first working position 58, thereupon into a zero or neutral position 59 and furthermore into the second working position 62. In the additional or fourth switching position 57 as it is also illustrated in FIG. 1, the axial relief groove 56 connects the first control chamber 33 to the first discharge chamber 31 which in turn communicates with the second discharge chamber 32 and the latter is connected through the right-hand transverse control groove 44 on the second spool section 43 to the second control chamber 35. At the same time the intake chamber 34 is blocked by the fifth piston section 44 and the second piston section 43.

The operation of the directional valve system 10 of this invention is as follows:

The basic functions of the electrohydraulic directional multi-way control valve system 10 is known from prior art. It will be only mentioned that the flow of pressure fluid from the pump port 17 to one of the load ports 15 or 16 is proportional to the signal which is applied to the input 55 of the electronic control device 26 and is indicative of the desired or nominal value whereby the proportional solenoid 42 displaces the preliminary control spool 29 against the force of spring 48 and in doing so precontrols the main control spool 14. Under normal operational conditions of the cooperating electronic and hydraulic devices the proportional solenoid 52 keeps the preliminary control spool 29 in its neutral or zero position 59. In the latter position the first and the second pressure chamber 21 and 22 are hydraulically blocked so that the main control spool 14 is positively held in any of its positions. Depending on the direction and magnitude of the nominal value signal applied to the input 55 of the electronic device 26, the main control spool 14 can be moved in one of two opposite directions whereby the preliminary control spool 29 is selectively brought by the proportional solenoid 52 into its first or second working position 58 or 61.

In the event that the flow of the pressure fluid is interrupted or if the electronic of the control device 26 becomes defective and the proportional solenoid 52 is deenergized, the spring 48 forces the preliminary control spool 29 to the left into its fourth switching position 57. In the latter position the fifth spool section 57 separates the intake chamber 34 from the first control chamber 33 and the second spool section 44 separates the intake chamber 34 from the second control chamber 35. At the same time the first pressure chamber 21 is connected to the second pressure chamber 22 via the control channel 37, the relief groove 56, the first and the second discharge chambers 31 and 32 and the right-hand control groove 44 on the second spool section 43, the second control chamber 35 and the second control channel 38. By virtue of the interconnection of the two pressure chambers the main control spool 14 is pressure balanced and by means of springs 23 and 24 is rapidly centered in its neutral position. A working cylinder of a non-illustrated machine connected to the load ports 15 and 16 is thus hydraulically blocked and is protected against any malfunction. By blocking the pressure of control fluid in the intake chamber 34 while simultaneously relieving the pressure chambers 21 and 22 to the return conduit 41, it is achieved that the springs 23 and 24 return the main control spool 14 in its neutral position with an extraordinary speed. In addition, the aforementioned interconnections of the pressure fluid in the additional or fourth switching position 57 as well as the circumstance that the spring 48 holds the preliminary control spool 29 in the latter switching position result in a double security. Moreover, by blocking the intake chamber 34 it is achieved that no pressure fluid can flow to the return conduit and consequently no energy losses can take place.

It will be understood that each of the elements described above, or two or more together, may also find a useful application in other types of constructions differing from the types described above. For instance, instead of the relief groove 56 as illustrated in FIG. 1, there can be employed also a different control member suitable for producing the desired connection of the pressure medium. In another modification, it is possible to actuate by a single proportional solenoid a 4/4-way control valve and preliminarily control thereby a 4/3-way main control valve in such a manner that with minimum expenditures a high degree of safety is achieved.

While the invention has been illustrated and described as embodied in an electrohydraulic directional multi-way control system of a specific type, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An electrohydraulic directional control valve system comprising, a preliminary directional control valve and a main directional control valve, said main control valve having a first housing provided with an intake port, a return port and at least two load ports; a first control spool movable in said first housing from a central neutral position into a respective one of two lateral working positions; a pressure chamber arranged at each end of said first spool; first spring means arranged in each pressure chamber to urge said first spool into said neutral position; control channels connecting, respectively, said pressure chambers to said preliminary control valve, said preliminary control valve having a second housing provided with control chambers; a second control spool movable in said second housing from a central neutral position into one of two lateral working positions in which pressure fluid is admitted through one of said control chambers into one of said pressure chambers and the other pressure chamber is released through said return port; second spring means arranged at one end of said second spool for urging the same into an additional position in which said control chambers and thus said pressure chambers are interconnected; and a proportionally operating solenoid acting on the other end of said second spool to counteract said second spring means.

2. A control valve system as defined in claim 1, including an intake channel connecting said intake port to said preliminary control valve, said second control spool separating in said additional switching position thereof said intake channel from said control chambers.

3. A control valve system as defined in claim 2, wherein said second control spool in said additional position thereof connects said control chambers to said return port.

4. A control valve system as defined in claim 3, wherein said second control spool has a central spool section, a first and a second spool section facing said central spool section, and a fourth and fifth spool section facing, respectively, said first and said second spool sections, said first and second spool sections being provided at each end thereof with a recessed transverse groove and said first spool section having an axially directed relief groove.

5. A control valve system as defined in claim 4, further including two discharge chambers each facing a control chamber and said relief groove in said first spool section exceeding in length the thickness of the wall of the second housing between the discharge chamber and the adjoining control chamber and being spaced apart from the transverse control groove in said first spool section which faces said central spool section and the ends of said relief groove being spaced from the end faces of said first spool section.

* * * * *